United States Patent [19]

Morishita et al.

[11] 4,015,347

[45] Apr. 5, 1977

[54] INSOLES EFFECTIVE FOR CURING AND PREVENTING ATHLETE'S FOOT

[76] Inventors: Kazuyoshi Morishita, No. 20-C-305, Hinage-Aza-Toube, Chita, Aichi; Nobuhiko Furukawa, No. 6-15, Yagumo 5-chome, Meguro, Tokyo, both of Japan

[22] Filed: Nov. 14, 1975

[21] Appl. No.: 631,854

[30] Foreign Application Priority Data

Dec. 28, 1974 Japan ..... 49-157492[U]
Sept. 1, 1975 Japan ..... 50-119217[U]

[52] U.S. Cl. ..... 36/44
[51] Int. Cl.² ..... A43B 13/38
[58] Field of Search ..... 36/43, 44

[56] References Cited

UNITED STATES PATENTS

| | | | |
|---|---|---|---|
| 34,702 | 3/1862 | Sloan | 36/44 |
| 634,361 | 10/1899 | Marlow | 36/43 |
| 2,061,911 | 11/1936 | Leindorf | 36/43 |
| 2,451,929 | 10/1948 | Dorgin | 36/44 |
| 3,007,083 | 10/1961 | MacQuaid et al. | 36/43 X |
| 3,624,930 | 12/1971 | Johnson et al. | 36/43 |
| 3,852,897 | 12/1974 | Bridge et al. | 36/44 |

FOREIGN PATENTS OR APPLICATIONS

| | | | |
|---|---|---|---|
| 1,270,809 | 4/1972 | United Kingdom | 36/44 |

*Primary Examiner*—Alfred R. Guest
*Attorney, Agent, or Firm*—Woodhams, Blanchard and Flynn

[57] ABSTRACT

An insole which is prepared by providing a metallic layer consisting of silver, copper or an alloy of these metals on the surface of a base constituting said insole or an insole prepared by molding a plastic material containing metallic particles of silver, copper or an alloy of these metals, is effective for treating as well as preventing athlete's foot.

7 Claims, 10 Drawing Figures

INSOLES EFFECTIVE FOR CURING AND PREVENTING ATHLETE'S FOOT

BACKGROUND OF THE INVENTION

1. Field of the Invention

The present invention relates to an improvement of insoles for use in footwear, particularly shoes.

2. Description of the Prior Art

Insoles made of leather or cloth are supposed to be useful not only for perfectly fitting toes to the inside of shoes during wear thereof and lessening percussion of the soles of shoes at the time of walking, but also for facilitating ventilation within shoes as far as possible lest the foot should become moist. But a sufficient ventilation effect and prevention of moisture accumulation cannot be expected from the use of conventional insoles. As a result, conditions exist which are favorable to the occurrence of athlete's foot infections. In treating athlete's foot, such methods as coating a treating material on the affected parts or steeping the affected parts in a medicated bath are popular. However, in these methods of treatment, the duration of efficacy of the remedies is rather short, so that unless the coating of the treating material or the steeping in medicated bath is continuously repeated every day with patience, they will have little effect. On top of this, such medical treatments are troublesome to practice. For the reasons stated above, athlete's foot has generally been hard to cure completely. And, there is no precedent for an insole which will be very effective in remedying or preventing athlete's foot.

SUMMARY OF THE INVENTION

As a result of studies made by the present inventors, it has been found that the habitual use of an insole prepared by providing a metallic layer consisting of silver, copper or an alloy of these metals on the surface of a base constituting said insole or an insole prepared by molding a plastic material comprising silver, copper or an alloy of these metals renders it possible to treat or prevent athlete's foot very effectively. The present invention has been accomplished on the basis of this finding.

DESCRIPTION OF THE PREFERRED EMBODIMENTS

Figure 1:
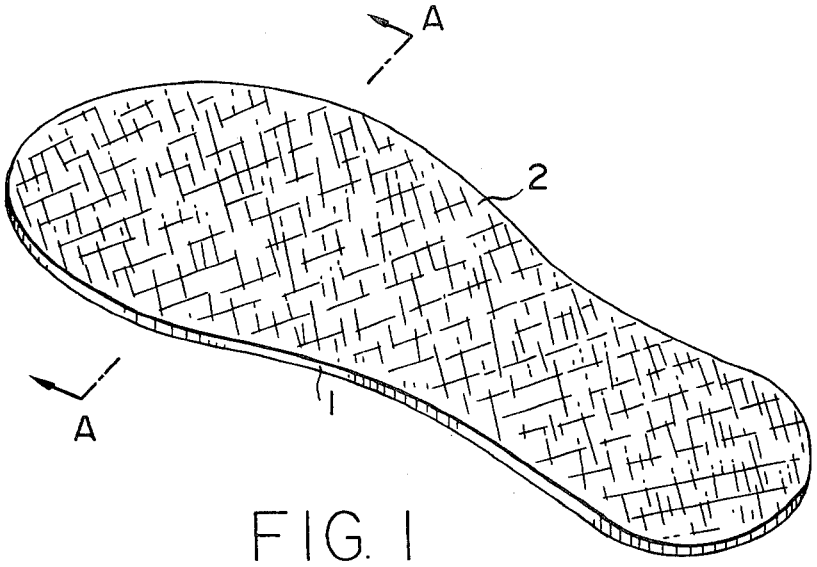

The priary etiological cause of athlete's foot is a species of mold called filamentous fungus. Silver, copper or alloys of these metals have a superb sterilizing effect on this filamentous fungus. Therefore, when an insole prepared by making a metal selected from the group consisting of silver, copper and alloys thereof present therein is habitually used, by virtue of direct contact between said metal and the site of the athlete's foot infection or even indirect contact between the two through socks, a very conspicuous sterilizing effect is displayed even when the affected parts are located in between toes, and is very effective for treating or preventing athlete's foot.

As regards the reason why said insole displays an excellent treating and preventive effect as above, even when the site of the athlete's foot infection and said metal are not in direct contact, it is likely that friction between the foot or socks and said metal produces fine particles of the metal or a metal compound such as basic copper carbonate, for instance, and further sweat produces a very small amount of metallic ions of these metal particles, and these ions reach the affected parts to exert a sterilizing effect or mitigating effect upon filamentous fungus. Accordingly, an insole as above has a merit that athlete's foot can be treated as well as prevented very effectively by just habitually applying it to the inside of shoes, without resorting to such intentional treatments as the coating of a treating agent on the affected parts or the steeping of the affected parts in a medicated bath.

The insole according to the present invention can be broadly classified into two types, to wit, one prepared by providing a metallic layer consisting of silver, copper or an alloy of these metals on the surface of a base constituting the insole in the shape of a whole foot-print or a part thereof and the other prepared by molding a plastic material containing particles of such a metal as above into a sheet in the shape of a whole foot-print or a part thereof.

The insole prepared by providing a metallic layer on the surface of a base in the shape of the intended insole includes one prepared by sticking a foil or a plate of metal on the surface of the base by means of an adhesive, one prepared by scattering and sticking metal grains or metal powder on the surface of the base upon applying an adhesive thereon, and one prepared by coating or fusing a material obtained by admixing metal grains or metal powder with an adhesive or a resin on the surface of the base.

As the material for the insole base for use in the present invention, natural leather, synthetic leather, pulp, felt, chemical felt, natural or synthetic fibrous non-woven cloth, etc. are applicable. And, as regards the shape of the insole in the present invention, a shape of complete foot-print, a shape of foot-print short of the portion corresponding to the heel and an optional shape smaller than foot-print are all applicable.

To site applicable adhesives for use in providing said metallic layer on the surface of the base, there are such synthetic resins as urea resin, melamine resin, phenol resin, epoxide resin, polyvinyl acetate, polyester, polyurethane, polyvinyl alcohol, polyacrylonitrile, etc. and natural or synthetic rubber.

And, to cite applicable synthetic resins for use in coating or fusing on the surface of the base upon admixing with metallic powder, there are polyethylene, polypropylene, polyvinyl chloride, polyamide, polyester, polyvinyl alcohol, polyacetal, etc.

At the time of forming said metallic layer by sticking a foil, a plate, grains or powder of metal on the surface of the base by the use of the foregoing adhesive or resin, such means as application of pressure, heat curing and the like can be employed.

The appended drawings illustrate insoles according to the present invention. In these drawings, FIG. 1 is a perspective view of an insole prepared by providing a metallic layer 2 all over the surface of an insole base 1 formed in the shape of a complete foot-print.

Figure 2:
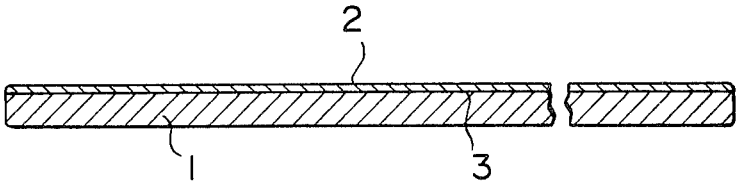

FIG. 2 is an enlarged sectional view taken along the line A—A in FIG. 1, wherein the reference numeral 3 denotes the adhesive layer.

Figure 3:
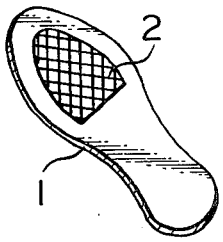
Figure 5:
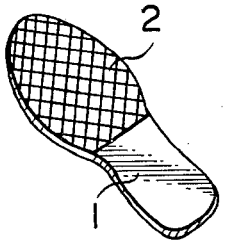
Figure 4:
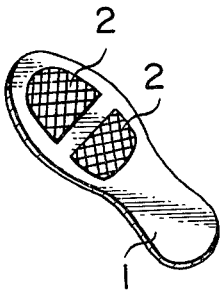

FIGS. 3, 4 and 5 are respectively perspective views, on a reduced scale, of insoles prepared by providing a metallic layer 2 of various shapes on a portion of the surface of a base 1.

Figure 6:
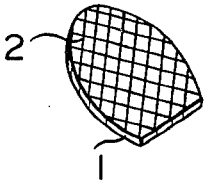
Figure 7:
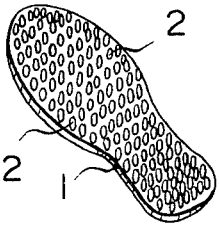

FIG. 6 is a perspective view, on a reduced scale, of an insole prepared by providing a metallic layer 2 all over the surface of a base 1 in the shape of foot-print minus the portion corresponding to the heel, and FIG. 7 is a perspective view, on a reduced scale, of an insole prepared by providing a metallic layer 2 taking the form of a multiplicity of discontinuous projections on the surface of a base 1 in the shape of foot-print.

The insole prepared by molding a plastic material containing particles of a metal selected from the group consisting of silver, copper and alloys of these metals can be manufactured by molding a material obtained by admixing said particles of metal with a plastic substance and further adding a filler thereto as occasion demands.

Figure 8:
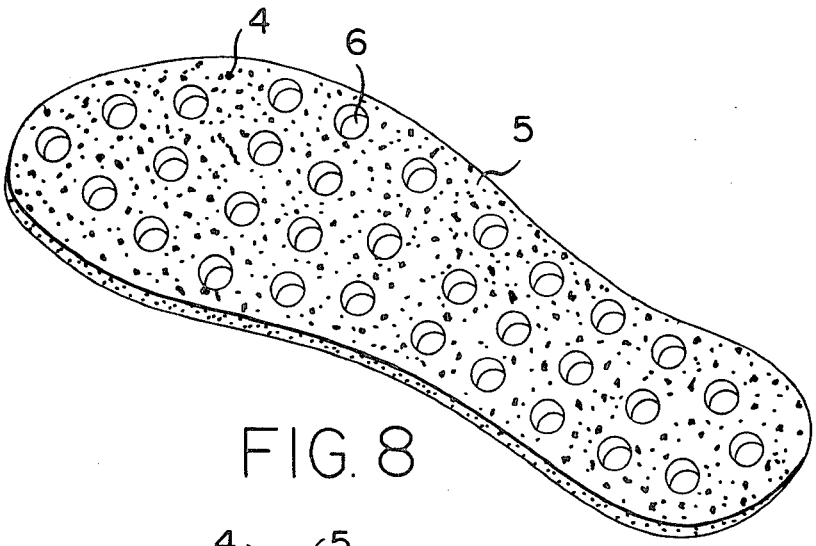

FIG. 8 is a perspective view of an insole prepared by molding a material obtained by admixing metal grains 4 with a plastic substance 5 into the shape of a sheet having a multiplicity of vents 6.

Figure 9:
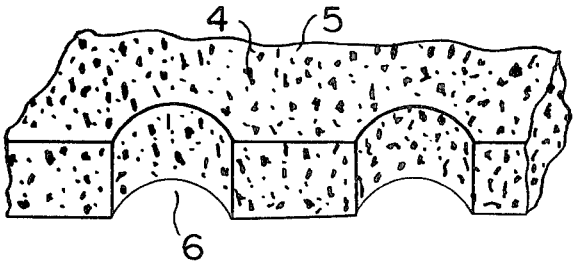

FIG. 9 is a partial perspective view, on an enlarged scale, of the insole shown in FIG. 8, cut through the vents.

Figure 10:
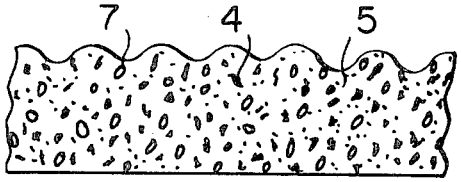

FIG. 10 is a partial sectional view, on an enlarged scale, of an insole prepared by molding a material obtained by admixing metal grains 4 and filler 7 with a plastic substance 5 into the shape of a sheet having the surface provided with a multiplicity of undulations.

As the plastic substance to be mixed with metallic particles, thermo-setting resins such as urea resin, melamine resin and phenol resin and thermoplastic resins such as polyvinyl chloride, polyvinyl acetate and polyurethane are applicable. In addition to these, natural rubber, synthetic rubber, pulp and pulp-like synthetic fiber are also applicable. Among the above substances, however, such thermoplastic resins as will provide moldings having moderate flexibility are particularly preferable.

As the particles of metal for use in the present insole, particles of a metal selected from the group consisting of silver, copper and alloys of these metals are employed. As to the shape of the particles herein, any of the granule-like shape, grain-like shape, powder-like shape, flinders-like shape and pellet-like shape will do: what is essential is that the size of said particles should be small enough for mixing well with the plastic substances. As the filler to be added as occasion demands, there are, for instance, calcium carbonate, diatomaceous earth, titanium oxide, natural leather as ground into fragments, pulverized wood, pulp and fibrous substances.

As regards the shape of the insole in the present invention, it will do to be in the shape of complete foot-print or in the shape of incomplete foot-print such as one obtained by omitting the portion corresponding to the heel. And, the surface of the insole can be either flat or provided with adequate undulations. Further, for the purpose of making it ventilative, the insole is preferably provided with a multiplicity of holes bored through it.

An insole prepared by molding a material obtained by admixing said particles of metal with a plastic substance is by far more durable compared with an insole prepared by providing a metallic layer simply on the surface of the base in which the metal may delaminate or deteriorate after a long period of use and is therefore free of deterioration of its effect of treating and preventing athlete's foot even when used for a long time.

EXAMPLE 1

After uniformly coating an epoxide resin-type adhesive (namely, ARALDITE AW-106, the manufacture of Ciba-Geigy Limited) to the extent of about 0.2 mm in thickness all over the surface of a base made from oxhide and having a shape of complete foot-print, scattering thereon copper powder and applying pressure lightly, by heating at a temperature in the range of from 70° to 80° C for about 30 minutes thereby to cure said epoxide resin, and then sweeping off non-adhering copper powder, an insole as shown in FIGS. 1 and 2 was prepared.

When this insole was employed as an insole for everyday use by sufferers from athlete's foot, athlete's foot almost completely disappeared in 3 to 4 weeks.

EXAMPLE 2

After coating a vinyl acetate-type adhesive (namely, DAIKI BOND, the manufacture of DAIKI PAINT Co., Ltd.) to the extent of about 0.1 mm in thickness on a part of the surface of an insole base made of a pulp molding and superposing a copper foil and sticking it thereon, by heating at a temperature in the range of from 80° to 90° C for about 5 minutes under a pressure of 3 $Kg/cm^2$ thereby to fix said copper foil, an insole as shown in FIG. 3 was prepared.

When this insole was employed as insole for everyday use by sufferers from athlete's foot, athlete's foot almost completely disappeared in 4 to 5 weeks.

EXAMPLE 3

After coating a phenol resin-type adhesive (namely, CEMEDINE No. 110, the manufacture of CEMEDINE Co., Ltd.) to the extent of about 0.1 mm in thickness all over the surface of an insole base made of felt, by scattering thereon silver powder, heating at a temperature in the range of from 90° to 100° C for about 1 hour to cure said phenol resin and then sweeping off non-adhering silver powder, an insole as shown in FIG. 6 was prepared.

When this insole was employed as an insole for everyday use by sufferers from athlete's foot, athlete's almost completely disappeared in about 4 weeks.

EXAMPLE 4

After partially coating a synthetic rubber-type adhesive (namely, BOND MASTER-G 442, the manufacture of SONY CHEMICAL Co., Ltd.) to the extent of about 0.1 mm in thickness on two portions of the surface of an insole base made of a chemical felt (a mixture molding consisting of rubber and synthetic fiber), by superposing a copper plate respectively on the thus coated portions, and heating at a temperature of 50° C for about 10 minutes thereby to cure said synthetic rubber and fix the copper plate, an insole as shown in FIG. 4 was prepared.

When this insole was employed as insole for everyday use by sufferers from athlete's foot, athlete's foot almost completely disappeared in 5 to 6 weeks.

EXAMPLE 5

After coating an epoxide resin-type adhesive (namely, ARALDITE AW-106, the manufacture of Ciba-Geigy Limited) to the extent of about 0.1 mm in thickness all over the surface, except for the heel portion, of an insole base made of non-woven cloth consisting of polyester fiber and superposing thereon a metallic foil consisting of brass (copper: 85 wt. %, zinc: 15 wt. %), by heating at a temperature in the range of from 60° to 70° C for about 15 minutes under a pressure of 3 Kg/cm² thereby to fix said metallic foil, an insole as shown in FIG. 5 was prepared.

When this insole was employed as insole for everyday use by sufferers from athlete's foot, athlete's foot almost completely disappeared in 5 to 6 weeks.

EXAMPLE 6

A mixture consisting of pulverized low-density polyethylene (melting point: about 85° C) and copper powder at the ratio of 3:1 was filled in a multiplicity of hollows provided on the surface of the molding side of a metal mold for insoles. Subsequently, a raw texture of unvulcanized chemical felt was laid on this metal mold and subjected to heating at a temperature in the range of from 120° to 130° C under a pressure of 10 Kg/cm² for 3 minutes, whereby said texture was vulcanized and at the same time the polyethylene in said mixture was melted and made to adhere closely thereto. Then, the thus processed texture was released from the metal mold and cooled with water for 5 minutes, whereby said mixture was hardened and stuck to the texture, and there was obtained an insole provided with a multiplicity of discontinuous metallic layers 2 in the form of projections as shown in FIG. 7.

When this insole was employed as an insole for everyday use by sufferers from athlete's foot, athlete's foot almost completely disappeared in about 6 weeks.

EXAMPLE 7

After uniformly mixing 70 parts by weight of ethylenevinyl acetate copolymer with 30 parts by weight of copper powder, by kneading the resulting mixture thoroughly by means of a roll at a high temperature of about 110° C and subjecting the thus kneaded mixture to pressure-molding by the use of a flat mold, a sheet was prepared. Subsequently, by cutting a footprint having vents from this sheet, an insole as shown in FIG. 8 was obtained.

When this insole was employed as an insole for everyday use by sufferers from athlete's foot, athlete's foot almost completely disappeared in 4 to 5 weeks.

EXAMPLE 8

After thoroughly and uniformly mixing 60 parts by weight of low-density polyethylene resin, 20 parts by weight of copper powder and 20 parts by weight of flinders of natural leather together, the resulting mixture was put in a melting tank and was melted by heating at a temperature of about 130° C for 20 minutes while stirring. The thus obtained melt was poured in a molding machine having its bottom provided with undulations and was cooled, whereby a sheet having undulations on its surface was prepared. Subsequently, by cutting a foot-print from this sheet, an insole having undulations on its surface as shown in FIG. 10 was obtained.

When this insole was employed as an insole for everyday use by sufferers from athlete's foot, athlete's foot almost completely disappeared in 3 to 4 weeks.

When those insoles obtained in the foregoing examples were employed for everyday use, starting from the wintertime, by persons liable to have athlete's foot every summer season, they never suffered from athlete's foot in the next year even during the summer season.

What is claimed is:

1. An insolve comprising a sheet of material having substantially the contour of a human foot or a portion of a human foot, said material comprising a moldable plastic having dispersed therein particles of a metal selected from the group consisting of silver, alloys of silver, copper and alloys of copper.

2. An insole according to claim 1 having a multiplicity of holes extending therethrough.

3. An insole according to claim 1, wherein said plastic consists of flexible thermoplastic resin.

4. An insole according to claim 1, wherein said plastic consists of thermo-setting resin.

5. An insole according to claim 1, wherein said plastic consists of a material selected from the group consisting of natural rubber, synthetic rubber, pulp and pulplike synthetic fiber.

6. An insolve according to claim 1, wherein said plastic also has dispersed therein particles of a filler selected from the group consisting of calcium carbonate, diatomaceous earth, titanium oxide, fragments of natural leather, pulverized wood, pulp and fibrous substances.

7. An insole according to claim 1, having an undulating surface.

* * * * *